US009769560B2

(12) United States Patent
Button

(10) Patent No.: US 9,769,560 B2
(45) Date of Patent: Sep. 19, 2017

(54) MANIFOLD FOR MULTIPLE COMPRESSION DRIVERS WITH A SINGLE POINT SOURCE EXIT

(71) Applicant: Harman International Industries, Inc, Stamford, CT (US)

(72) Inventor: Douglas J. Button, Simi Valley, CA (US)

(73) Assignee: HARMAN INTERNATIONAL INDUSTRIES, INCORPORATED, Stamford, CT (US)

( * ) Notice: Subject to any disclaimer, the term of this patent is extended or adjusted under 35 U.S.C. 154(b) by 226 days.

(21) Appl. No.: 14/735,078

(22) Filed: Jun. 9, 2015

(65) Prior Publication Data

US 2016/0366510 A1 Dec. 15, 2016

(51) Int. Cl.
*H04R 1/02* (2006.01)
*H04R 1/28* (2006.01)
(Continued)

(52) U.S. Cl.
CPC ..... *H04R 1/2865* (2013.01); *H04R 1/30* (2013.01); *H04R 9/063* (2013.01); *H04R 27/00* (2013.01); *H04R 2400/13* (2013.01)

(58) Field of Classification Search
CPC ..... H04R 1/2865; H04R 1/30; H04R 9/063; H04R 2400/13; H04R 27/00; G10K 11/00;
(Continued)

(56) References Cited

U.S. PATENT DOCUMENTS 1,849,840 A * 3/1932 Kellogg ..... G10K 11/025 181/187
3,842,203 A * 10/1974 Weisberg ..... H04R 1/30 381/182
(Continued)

FOREIGN PATENT DOCUMENTS

GB 2493922 A 2/2013

OTHER PUBLICATIONS

Extended European Search Report Application No. 16170704.7, dated Oct. 21, 2016, 9 pages.

*Primary Examiner* — Duc Nguyen
*Assistant Examiner* — Taunya McCarty
(74) *Attorney, Agent, or Firm* — Artegis Law Group, LLP

(57) ABSTRACT

In one embodiment of the present invention, a manifold composites sound from multiple drivers into a single aperture that includes multiple concentric rings. In operation, channels within the manifold isolate the sound generated by each driver from the sound generated by the other drivers. The channels within the manifold are intertwined to route the sound from each driver to a separate location in one of the multiple concentric rings. When the sound generated by each of the drivers is judiciously and deterministically delayed, the manifold generates a single point source of sound that may be fed into an acoustic horn. Notably, by isolating the sound generated by each driver, the manifold minimizes reflections and resonances that often degrade the sound fidelity of conventional horn loudspeakers. Consequently, the disclosed manifold enables an acoustic horn to project coherent sound for significantly longer distances than the acoustic horn would achieve using a conventional manifold.

20 Claims, 6 Drawing Sheets

(51) Int. Cl.
*H04R 1/30* (2006.01)
*H04R 9/06* (2006.01)
*H04R 27/00* (2006.01)

(58) Field of Classification Search
CPC .. G10K 11/002; G10K 11/004; G10K 11/025; G10K 11/04; G10K 7/00; G10K 9/00; G10K 9/22
See application file for complete search history.

(56) References Cited

U.S. PATENT DOCUMENTS 3,957,134 A * 5/1976 Daniel ..... G10K 11/30 181/176
4,157,741 A * 6/1979 Goldwater ..... H04R 1/30 181/156
4,437,540 A 3/1984 Murakami et al.
4,629,029 A 12/1986 Gunness
4,733,749 A * 3/1988 Newman ..... H04R 1/227 181/144
4,796,009 A * 1/1989 Biersach ..... G10K 11/025 181/144
4,882,562 A * 11/1989 Andrews ..... H04R 1/30 181/185
4,923,031 A 5/1990 Carlson
5,146,508 A * 9/1992 Bader ..... G10K 11/025 381/152
5,321,388 A * 6/1994 Biersach ..... G10K 11/025 181/142
5,526,456 A * 6/1996 Heinz ..... H04R 1/26 181/152
5,715,322 A * 2/1998 Yoshioka ..... H04R 1/30 181/144
6,343,133 B1 * 1/2002 Adamson ..... H04R 1/26 181/152
6,668,969 B2 * 12/2003 Meyer ..... G10K 11/025 181/159
7,392,880 B2 * 7/2008 Buck ..... H04R 1/30 181/144
7,837,006 B1 * 11/2010 Graber ..... G10K 11/28 181/144
8,050,442 B1 11/2011 Graber
8,194,905 B1 * 6/2012 Vinther, Sr. ..... H04R 1/26 381/181
8,989,419 B2 * 3/2015 Graber ..... H04R 1/345 381/339
2006/0034475 A1 * 2/2006 Geddes ..... H04R 1/345 381/343
2012/0223620 A1 * 9/2012 Buccafusca ..... G10K 11/025 310/335
2014/0270308 A1 * 9/2014 Donarski ..... G10K 11/025 381/340
2015/0090521 A1 * 4/2015 Blore ..... G10K 11/025 181/192
2015/0373445 A1 * 12/2015 Voishvillo ..... H04R 1/30 381/150

* cited by examiner

| Channel Length / Time Delay Constraints 555 | | | | | |
|---|---|---|---|---|---|
| Group | Phasing Plug Ring | Channel Length / Time Delay | Drivers | | |
| A | $255_1$ | $length_1$ / $time_1$ | $160_1$ | $160_3$ | $160_5$ |
| B | $255_2$ | $length_2$ / $time_2$ | $160_2$ | $160_4$ | $160_6$ |
| C | $255_3$ | $length_3$ / $time_3$ | $160_7$ | $160_9$ | $160_{11}$ |
| D | $255_4$ | $length_4$ / $time_4$ | $160_8$ | $160_{10}$ | $160_{12}$ |

MANIFOLD FOR MULTIPLE COMPRESSION DRIVERS WITH A SINGLE POINT SOURCE EXIT

BACKGROUND

Field of the Invention

Embodiments of the present invention relate generally to loudspeaker systems and, more specifically, to a manifold for multiple compression drivers with a single point source exit.

Description of the Related Art

Multiple compression drivers are commonly used to drive acoustic horns in loudspeakers that are designed to project sound for relatively long distances. For example, a loudspeaker in a public address system that is capable of projecting sound for hundreds of feet would typically include numerous compression drivers. However, when two compression drivers emit sound waves, the sound waves may generate acoustical reflections and interference. Such reflections and interference can lead to comb filtering (i.e., reinforcement of some sound waves and cancellation of other sound waves) and/or acoustic interference patterns that compromise the fidelity and intelligibility of the overall sound for the audience.

In an effort to achieve high sound pressure levels and, consequently, audio volumes while reducing comb filtering and acoustic interference patterns, various techniques for arranging multiple compression drivers have been employed. In such techniques, multiple compression drivers are usually mounted in a manifold that delivers sound to the throat end of the acoustic horn of the loudspeaker. In one such design, four compression drivers can be arranged within a relatively small manifold area. Two of the compression drivers form a skewed (i.e., "Y") configuration, and the other two compression drivers are directly opposed to each other. With this overall configuration, the manifold routes the sound waves from the skewed drivers at angles of approximately forty-five degrees, reflects the sound waves from the opposed drivers at approximately ninety degrees, and then combines the four resulting sound waves to create an aggregated sound.

One drawback of this particular approach is that acoustic reflections and interference still persist within the manifold that can degrade the overall quality of the sound emanating from the manifold. In particular, the interactions of the four sound waves within the manifold can produce artifacts, such as crossmodes, that remain present when the four waveforms are combined. Those crossmodes and other similar artifacts degrade the quality of the sound ultimately produced via the manifold, which hinders the ability to produce high fidelity sound. In general, conventional approaches to combining multiple compression drivers suffer similar sound degradation that is attributable to interference and/or reflections within the manifold.

As the foregoing illustrates, more effective techniques for generating high fidelity sound through loudspeakers would be useful.

SUMMARY

One or more embodiments set forth include a manifold for a loudspeaker. The manifold includes multiple inlets, where each inlet is designed to receive sound waves from a different compression driver; an output section that includes multiple concentric rings and is designed to deliver a point source of sound to a throat section of an acoustic horn; and a first channel that is configured to guide sound waves received at a first inlet to a first location within a first concentric ring and to isolate the sound waves received at the first inlet from sound waves received at the other inlets.

Other embodiments include, without limitation, a method to implement one or more of the aspects of the disclosed methods as well as a speaker configured to implement one or more of the aspects of the disclosed methods.

At least one advantage of the disclosed techniques is they enable loudspeakers to combine compression drivers in a manner that minimizes both comb filtering and acoustic interference patterns that can compromise the fidelity and intelligibility of the overall sound. As a result such loudspeakers generate high sound pressure levels without suffering from sound quality degradation typically associated with loudspeakers that are designed using conventional multi-driver techniques.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

In the following description, numerous specific details are set forth to provide a more thorough understanding of the present invention. However, it will be apparent to one of skill in the art that the present invention may be practiced without one or more of these specific details.

Audio System

Figure 1:
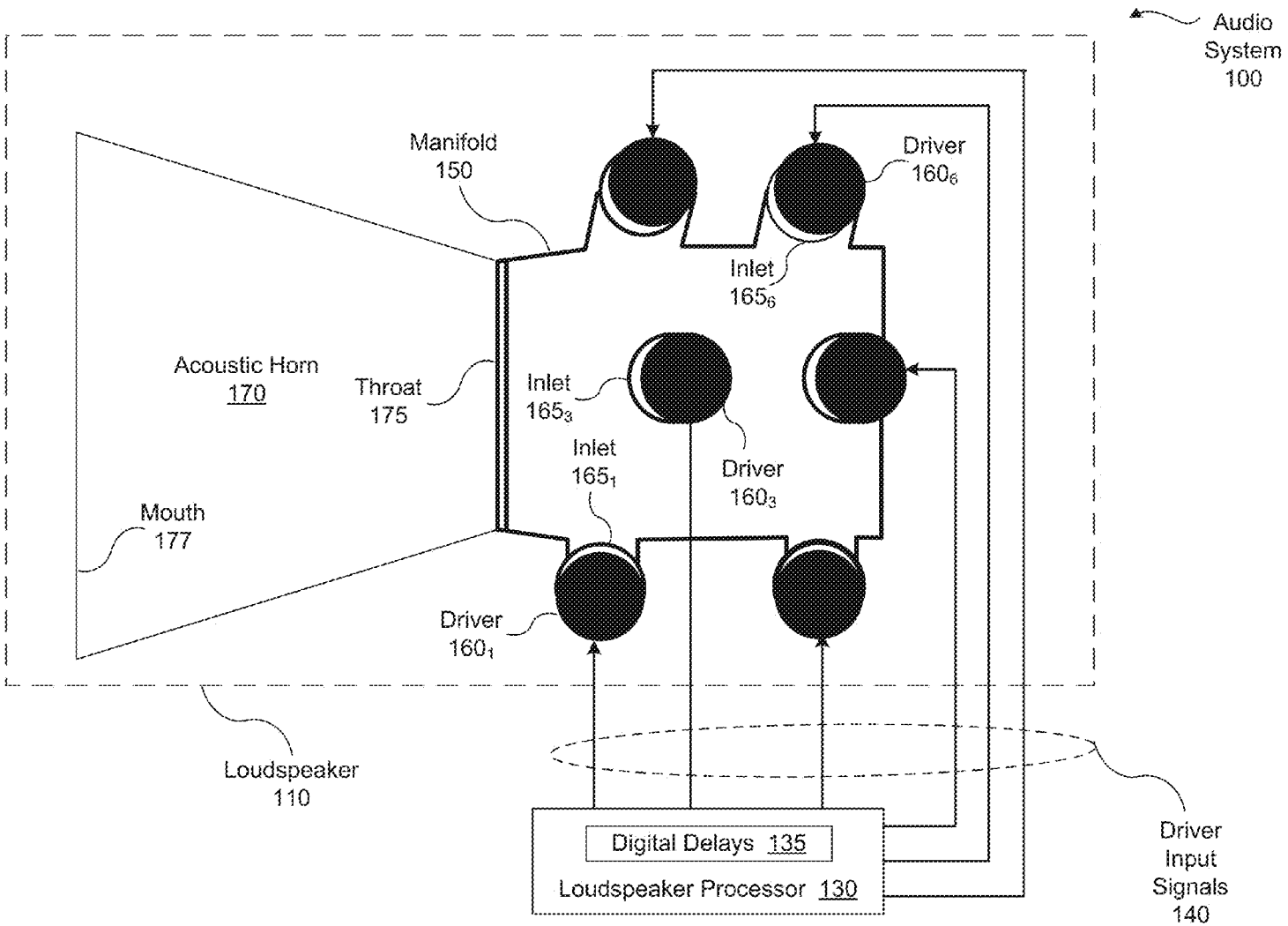
FIG. 1 illustrates an audio system configured to implement one or more aspects of the various embodiments.

FIG. 1 illustrates an audio system 100 configured to implement one or more aspects of the various embodiments. As shown, the audio system 100 includes, without limitation, a loudspeaker 110 and a loudspeaker processor 130. In alternate embodiments, the audio system 100 may include any number of loudspeakers 110 and any number of loudspeaker processors 130. Further, the loudspeaker processor 130 may be integrated into the loudspeaker 110 or replaced with any other integrated or stand-alone control unit. In various embodiments, the audio system 100 may include any number and type of audio equipment in any combination.

The loudspeaker 110 is a "horn" loudspeaker that is designed to transform electrical audio signals into sounds characterized by relatively high sound pressure levels. Accordingly, horn loudspeakers are widely used in audio systems that are tailored to deliver intelligible sound volumes to audiences dispersed across large areas, such as public address systems in auditoriums. As shown, the loudspeaker 110 includes, without limitation, a manifold 150 and an acoustic horn 170.

To facilitate the generation of high sound pressure levels, the manifold 150 includes multiple inlets 165. Although only six of the inlets 165 are visible in FIG. 1, the manifold 150 also includes six inlets 165 that are "hidden" from view. In operation, each of the inlets 165 receives sound waves generated by a separate driver 160 (also known as a compression driver). The manifold 150 guides the sound waves from the inlets 165 to a throat 175 of the acoustic horn 170. As the sound waves travel from the relatively narrow throat 175 to a relatively wide mouth 177 of the acoustic horn 170, the gradual increase in width of the acoustic horn 170 effectively increases the efficiency of the drivers 160. In this fashion, the loudspeaker 110 coherently combines the sound waves produced by the drivers 160 to provide high sound pressure levels in a relatively small footprint.

In alternate embodiments, the loudspeaker 110 may include any number of driver 160/inlet 165 pairs (i.e., the driver 160 connected to the inlet 165), and the inlets 165 may be distributed in any fashion across the manifold 150. The manifold 150 may be created in any technically feasible fashion and using any types of material in any combination. For example, and without limitation, three-dimensional (3D) printing techniques may be used to generate the manifold 150 from industrial grade plastic material. Further, each inlet 165 may be coupled to the corresponding driver 160 is any technically feasible fashion. For example, and without limitation, in some embodiments the inlets 165 may include female threads, the drivers 160 may include male threads, and as part of assembling the loudspeaker 110, the drivers 160 may be screwed into the inlets 165.

In conventional multiple driver horn loudspeakers, to achieve high sound pressure levels at the mouth of the acoustic horn, the fidelity of the overall sound emitted by the loudspeaker is compromised. More specifically, although typical manifolds in such loudspeakers attempt to judiciously control the sound waves generated by the drivers, the sound waves are subject to interference and reflections within the manifold that often lead to unexpected and uncompensated interactions between sound waves. The combinations of such uncompensated side-effects incurred as the sound waves travel through the manifold will noticeably degrade the sound quality for the audience.

Generating Coherent Sound

To address the foregoing concerns, the manifold 150 is designed to minimize reflections, resonances, and undesirable sound wave interactions within the manifold 150, and then emit a single point source of sound (e.g., a relatively small emission region that drives the throat 175 of the acoustic horn 170). As is well known, a single point source of sound provides highly coherent sound. Because the manifold 150 both maintains the integrity of the sound waves travelling through the manifold 150 and then delivers the sound waves as a single point source of sound, the manifold 150 provides high sound pressure levels while optimizing the sound quality.

To minimize sound wave interactions within the manifold 150, the manifold 150 includes internal channels (not shown in FIG. 1) that isolate the sound waves generated by each of the drivers 160 from the sound waves generated by the remaining drivers 160 throughout the manifold 150. Further, to minimize reflections, crossmodes, and resonances, each of these channels is relatively thin. For example, and without limitation, in some implementations the channel width is no greater than half of the highest wavelength that is intended to be reproduced by the loudspeaker 110.

Each of the channels terminates in at least one "slot" (i.e., narrow apertures) that subdivide one of multiple phasing plug rings (not shown in FIG. 1)—a series of concentric rings that, together, define where the isolated sound waves exit the manifold 150 and enter the throat 175 of the acoustic horn 170. For example, and without limitation, in some embodiments, the manifold 150 includes four phasing plug rings, each of the phasing plug rings is subdivided into three slots, and each of the twelve inlets 165 is connected via a channel to one of the slots in one of the phasing plug rings. In this fashion, the manifold 150 ensures that the sound waves from each of the drivers 160 are isolated from where the sound waves enter the manifold 150 at the inlet 165 to a corresponding slot in one of the phasing plug rings where the sound waves exit the manifold 150. Advantageously, this structure dramatically reduces the multipath wave propagation that is characteristic of sound waves travelling through conventional manifolds.

The length travelled by the sound waves emitted from each of the drivers 160 to reach the phasing plug ring depends on the routing of the channel within the manifold 150, the location of the corresponding inlet 165 and the location of the slot and the phasing plug ring. To facilitate time-alignment of sound waves that travel through channels of differing lengths and, consequently, increase the coherence of the sound that exits the manifold 150, each inlet 165 included in the manifold 150 is associated with a time delay that compensates for the differing channel lengths. In some embodiments, to simplify the time-alignment process, the channels are interwoven in a pattern that subdivides the channels into groups, where the channels in a particular group are characterized by an equal length and a corresponding per-group time delay. For example, and without limitation, in one embodiment, for each phasing plug ring, the phasing plug ring is associated with a group and the manifold 150 is structured such that the channels that terminate at the phasing plug ring are of substantially the same length.

In operation, to ensure that the sound waves from each of the drivers 160 exit the manifold 150 at substantially the same time, the loudspeaker processor 130 is configured to apply appropriate digital delays 135 to the electrical audio signals that are to be broadcast via the loudspeaker 150. The resulting signals, shown as driver input signals 140, are routed in any technically feasible fashion (e.g., speaker wiring, etc.) to the corresponding drivers 160. In general, the loudspeaker processor 130 is configured to impose the digital delays 135 that reflect the per-group time delays. For instance, and without limitation, the digital delays 135 that the loudspeaker processor 130 applies to the drivers 160 that drive relatively short channels are longer than the digital delays 135 that the loudspeaker processor 130 applies to the drivers 160 that are routed via relatively long channels. Performing these time-alignment operations enables the manifold 150 to deliver the optimized single point source of sound to the throat 175 of the acoustic horn 170 with a desired wave front curvature from flat to suitably spherical depending on the application.

In alternate implementations, the loudspeaker processor 130 may be replaced by any type of device that controls the inputs to the drivers 160. Further the digital delays 135 may be replaced by any sort of delay mechanism that enables the time-alignment process, and the delay mechanism may be a stand-alone unit, integrated in the loudspeaker processor 130, integrated into the drivers 160, or applied via the manifold 150.

For illustrative purposes, FIGS. 1-5 describe particular embodiments of the manifold 150, the loudspeaker 110, and the audio system 100. It will be appreciated that the various units, including and without limitation, the manifold 150, the loudspeaker 110, and the audio system 100 shown herein are illustrative and that variations and modifications are possible. Notably, and without limitation, the manifold 150 may be of any size and shape that enables implementation of the general techniques (e.g., thin, isolated channels, time-alignment, etc.) described herein. In alternate embodiments, the manifold 150 may include, without limitation, any number of channels, the inlets 165, and the drivers 160 disposed in any manner across the manifold 150. Further, the manifold 150 may terminate in any number of the phasing plug rings, with any number of slots included in each of the phasing plug rings, and the number of slots may differ between the phasing plug rings. In other embodiments, the phasing plug rings may be implemented in some manner other than concentric rings that enables the manifold 150 to deliver a single point source of sound to the throat 175 of the acoustic horn 170.

Three-Dimensional (3D) View of the Manifold

Figure 2:
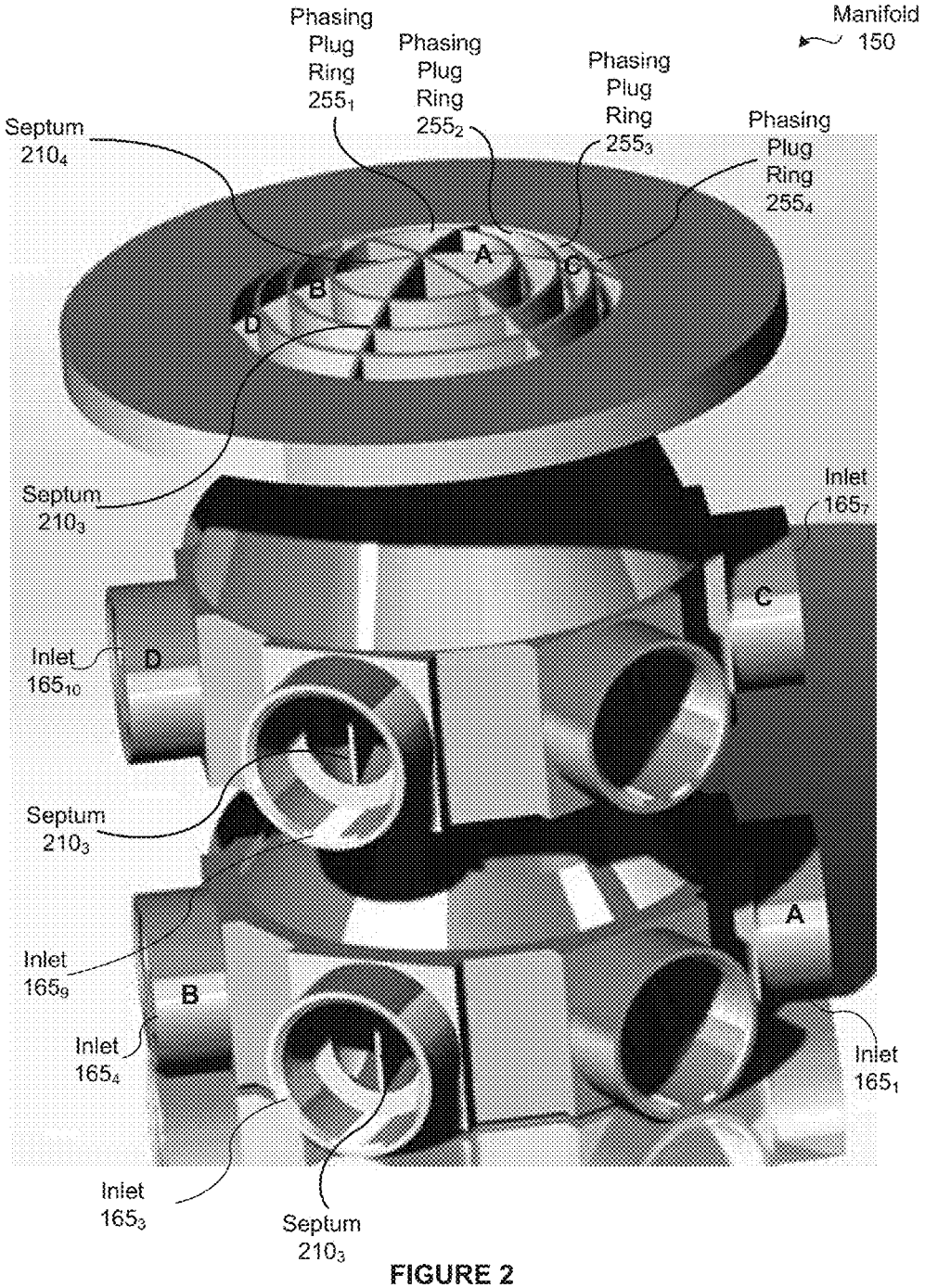
FIG. 2 is a three-dimensional (3D) view of the manifold of FIG. 1, according to various embodiments.

FIG. 2 is a three-dimensional (3D) view of the manifold 150 of FIG. 1, according to various embodiments. In the manifold 150, the inlets 165 are arranged into two rows that each include six of the inlets 165. Although only six of the inlets 165 are visible in FIG. 1, the manifold 150 also includes six inlets 165 that are "hidden" from view. The manifold 150 also includes four phasing plug rings 255.

As shown, the manifold 150 includes, without limitation, six septa 210. Each channel may have multiple divisions (e.g. septa 210) to minimize channel width. Together, the septa 210 divide the phasing plug rings 255 into a total of twenty-four exit slots. The septa 210 then extend internally from the exit slots, defining the channels followed by wave forms that enter the manifold 150 via the inlets 165. Notably, the septa 210 are interwoven in a manner such that each of the septa 210 serves as the "wall" for two of the channels and bisects another two of the channels. For example, and without limitation, the septum $\mathbf{210}_3$ serves as the left wall of the inlets $\mathbf{165}_2$ (situated on the bottom row) and $\mathbf{165}_8$ (situated on the top row), serves as the right wall of the inlets $\mathbf{165}_4$ (situated on the bottom row) and $\mathbf{165}_{10}$ (situated on the top row), and bisects the inlets $\mathbf{165}_3$ (situated on the bottom row) and $\mathbf{165}_9$ (situated on the top row). Advantageously, the septa 210 not only facilitate the routing and separation of sound waves within the manifold 150, but also structurally reinforce the manifold 150.

In alternate embodiments, the manifold 150 may include any number of the septa 210, including zero, and the septa 210 may serve any type of function. For example, and without limitation, the septa 210 may provide routing functionality, isolation functionality, and/or structural reinforcement in any combination and in conjunction with any other geometric features of the manifold 150.

For illustrative purposes, FIG. 2 depicts the input and the output of four of the channels. As shown, a label "A" illustrates that the sound waves entering the manifold 150 via the inlet $\mathbf{165}_1$ (included in the bottom row) exit the manifold 150 via the two slots that are included in the innermost phasing plug ring $\mathbf{255}_1$ on either side of the septa $\mathbf{210}_1$. A label "B" illustrates that the sound waves entering the manifold 150 via the inlet $\mathbf{165}_4$ (included in the bottom row) exit the manifold 150 via the two slots that are included in the phasing plug ring $\mathbf{255}_2$ on either side of the septa $\mathbf{210}_4$. A label "C" illustrates that the sound waves entering the manifold 150 via the inlet $\mathbf{165}_7$ (included in the top row) exit the manifold 150 via the two slots that are included in the phasing plug ring $\mathbf{255}_3$ on either side of the septa $\mathbf{210}_1$. A label "D" illustrates that the sound waves entering the manifold 150 via the inlet $\mathbf{165}_{10}$ (included in the top row) exit the manifold 150 via the two slots that are included in the outermost phasing plug ring $\mathbf{255}_4$ and on either side of the septa $\mathbf{210}_4$.

Two-Dimensional (2D) Cross-Sections of the Manifold

Figure 3:
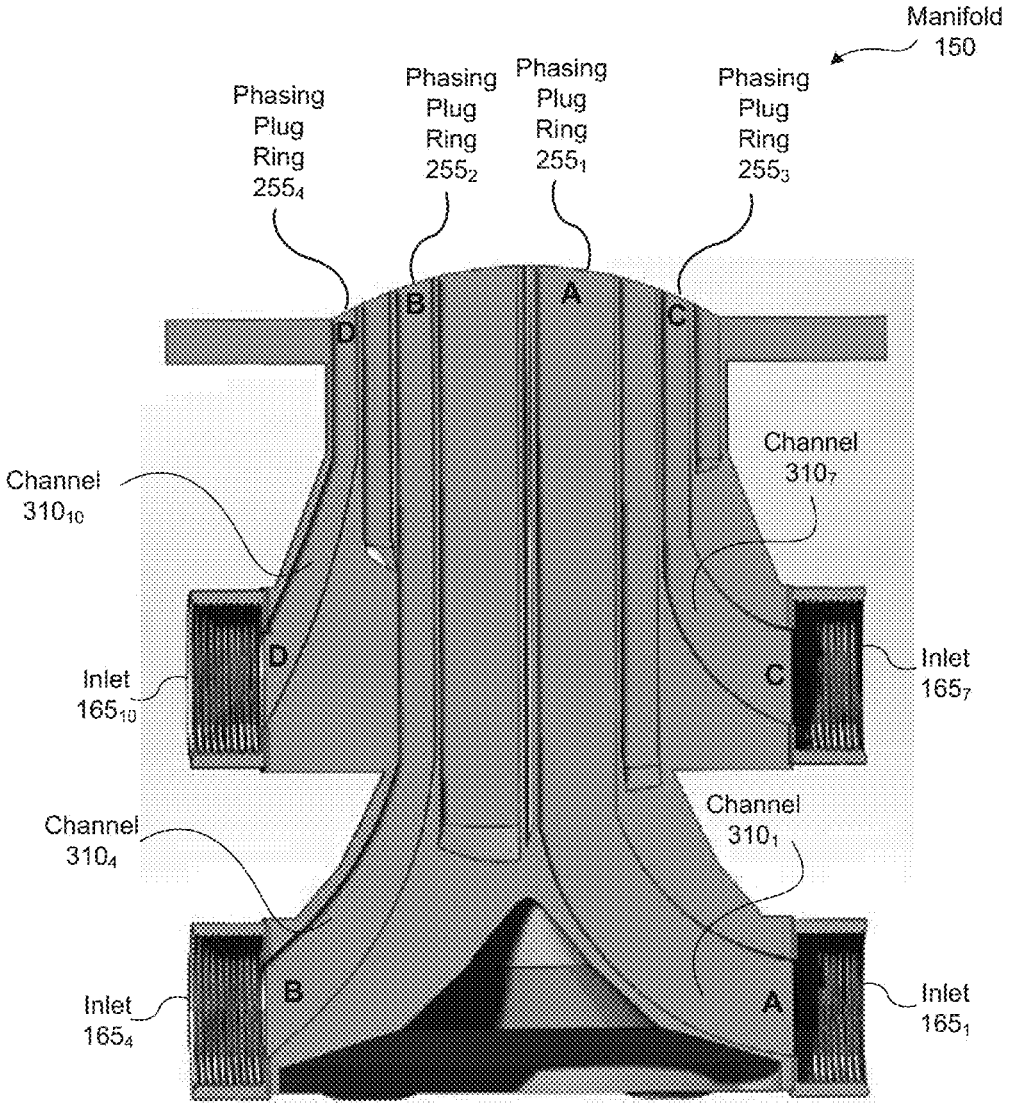
FIG. 3 is a two-dimensional (2D) cross-section of the 3D view of FIG. 2, according to various embodiments.

FIG. 3 is a two-dimensional (2D) cross-section of the 3D view of FIG. 2, according to various embodiments. As shown, the manifold 150 includes channels 310 that shield the sound waves from each of the drivers 160 against interactions with the sound waves from the other drivers 160 throughout the length of the manifold 150. Eight of the channels 310 are visible in FIG. 3, and another four of the channels 310 are hidden from view.

For illustrative purposes, FIG. 3 depicts the input and the output of the channels $\mathbf{310}_1$, $\mathbf{310}_4$, $\mathbf{310}_7$, and $\mathbf{310}_{10}$. As shown, a label "A" illustrates that the channel $\mathbf{310}_1$ routes sound waves entering the manifold 150 via the inlet $\mathbf{165}_1$ (included in the bottom row) to the innermost phasing plug ring $\mathbf{255}_1$. A label "B" illustrates that the channel $\mathbf{310}_4$ routes sound waves entering the manifold 150 via the inlet $\mathbf{165}_4$ (included in the bottom row) to the phasing plug ring $\mathbf{255}_2$. A label "C" illustrates that the channel $\mathbf{310}_7$ routes sound waves entering the manifold 150 via the inlet $\mathbf{165}_7$ (included in the top row) to the phasing plug ring $\mathbf{255}_3$. A label "D" illustrates that the channel $\mathbf{310}_{10}$ routes sound waves entering the manifold 150 via the inlet $\mathbf{165}_{10}$ (included in the top row) to the outermost phasing plug ring $\mathbf{255}_4$.

Notably, the length of the channel $\mathbf{310}_1$ is visibly longer than then length of the channel $\mathbf{310}_4$, the length of the channel $\mathbf{310}_4$ is visibly longer than then length of the channel $\mathbf{310}_7$, and the length of the channel $\mathbf{310}_7$ is visibly longer than then length of the channel $\mathbf{310}_{10}$. Accordingly, to ensure proper time alignment of the sound waves, the loudspeaker processor 130 is configured to apply a relatively small value for the digital delay $\mathbf{135}_1$ to the driver input signal $\mathbf{140}_1$ that feeds the driver $\mathbf{160}_1$, a larger value for the digital delay $\mathbf{135}_4$ to the driver input signal $\mathbf{140}_4$ that feeds the driver $\mathbf{160}_4$, a larger value for the digital delay $\mathbf{135}_7$ to the driver input signal $\mathbf{140}_7$ that feeds the driver $\mathbf{160}_7$, and a relatively large value for the digital delay $\mathbf{135}_{10}$ to the driver input signal $\mathbf{140}_{10}$ that feeds the driver $\mathbf{160}_{10}$.

Figure 4:
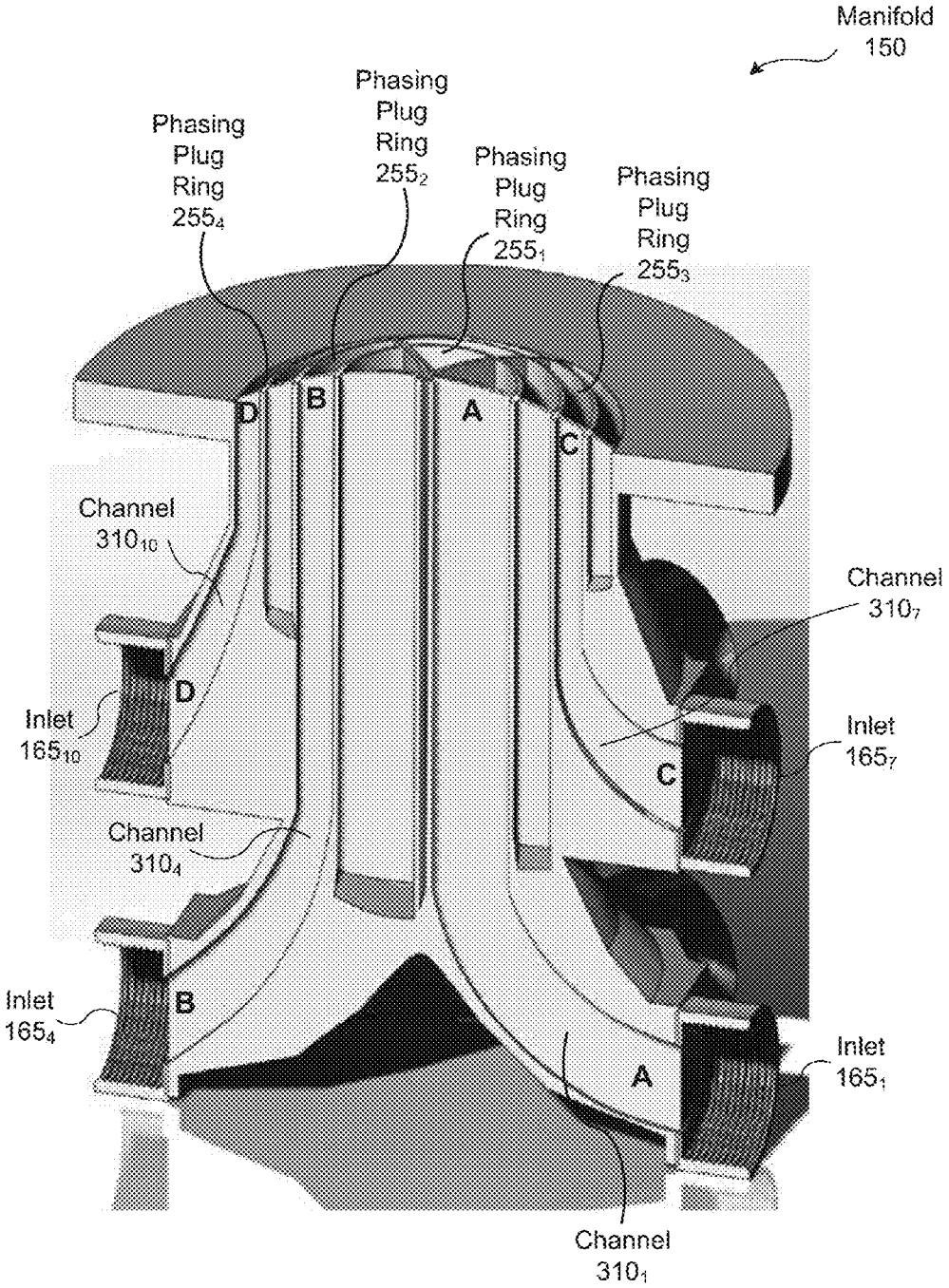
FIG. 4 is a second two-dimensional (2D) cross-section of the 3D view of FIG. 2, according to various embodiments.

FIG. 4 is a second two-dimensional (2D) cross-section of the 3D view of FIG. 2, according to various embodiments. In addition to the features that are visible in FIG. 3, FIG. 4 also illustrates the slots included in the phasing plug rings 255 in greater detail. As shown, the geometric shape of the slots may vary. For example, and without limitation, the slots included in the innermost phasing plug ring $\mathbf{255}_1$ are roughly three-sided. By contrast, the slots included in the outermost phasing plug ring $\mathbf{255}_4$ are roughly three-sided. In general, the number and/or geometries of the slots may vary across the phasing plug rings 255 and/or within each of the phasing plug rings 255.

Further, each of the drivers 160 may be oriented at any angle with respect to the direction of the corresponding channel 310. For example, and without imitation, in the embodiment depicted in FIG. 4, based on the relative orientations of the inlet $\mathbf{165}_i$ and the channel $\mathbf{310}_i$, the driver $\mathbf{160}_i$ is oriented at approximately ninety degrees with respect to the direction of the channel $\mathbf{310}_i$. In alternate embodiments, without limitation, the exit of each of the drivers 160 may be "slanted" such that the angles of the inlets 165 and the entrances to the manifold 150 (as connected via the channels 310), align along the same general vector.

drivers do not need to be 90 degrees from the direction of the channel. It may be more appropriate for the driver exit to be in the same general vector as the entrance of the manifold (slanted)

Phasing Plug Rings

Figure 5:
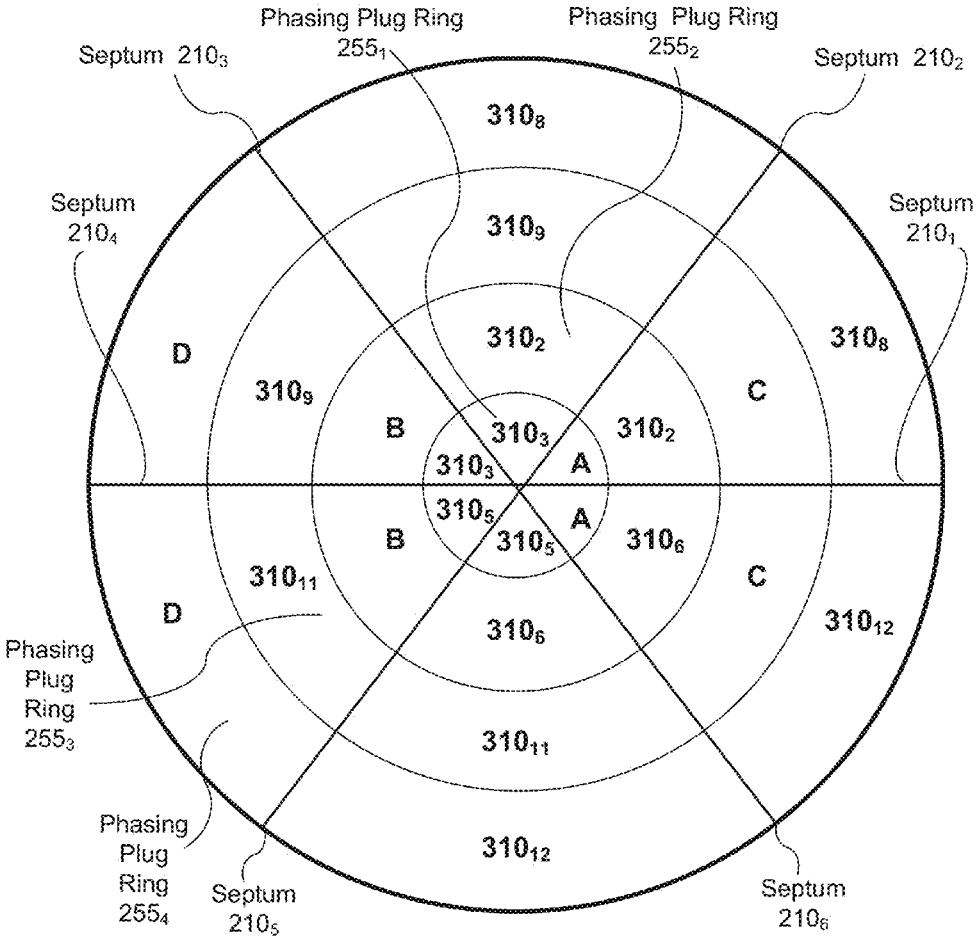
FIG. 5 is a more detailed illustration of the phasing plug rings depicted in FIG. 2, according to various embodiments.

FIG. 5 is a more detailed illustration of the phasing plug rings 255 depicted in FIG. 2, according to various embodiments. In general, the phasing plug rings 255 organize the sound waves that the manifold 150 routes from the inlets 165 and through the channels 310 into a pattern at the exit of the manifold 150 that is consistent with a single point source of sound.

As shown, the phasing plug ring $\mathbf{255}_1$ is the innermost of the four phasing plug rings 255, phasing plug ring $\mathbf{255}_2$ is an encompassing concentric ring that is adjacent to the phasing plug ring $\mathbf{255}_1$, phasing plug ring $\mathbf{255}_3$ is a encompassing concentric ring that is adjacent to the phasing plug ring $\mathbf{255}_2$, and phasing plug ring $\mathbf{255}_4$ is the outermost of the four phasing plug rings 255. Six septa $\mathbf{210}_1$-$\mathbf{210}_6$ subdivide each of the phasing plug rings 255 into six slots. Referring to FIG. 2, each of the septa 210 bisects two of the inlets 165—one in the bottom layer that includes six of the inlets 165 and one in the top layer that includes the remaining six of the inlets 165. For example, and without limitation, the septum $\mathbf{210}_3$ bisects the inlets $\mathbf{165}_3$ and $\mathbf{165}_9$. Referring back now to FIG. 5, the septum $\mathbf{210}_3$ bisects the channel $\mathbf{310}_3$ that routes sound waves from the inlet $\mathbf{165}_3$ to the two slots located in phasing plug ring $\mathbf{255}_1$ on either side of the septum $\mathbf{210}_3$. In a similar fashion, each of the remaining channels 310 route sound waves from one of the inlets 165 to two slots located in one of the phasing plug rings 255.

In alternate embodiments, the septa 210 are omitted and each inlet 165 feeds a single slot in one of the phasing plug rings 255. In general, any number of septa 210 may be included in the manifold 150 and may intersect any number of the inlets 165, the channels 310, and the phasing plug rings 255 in any technically feasible fashion that preserves the isolation between the inlets 165 throughout the manifold 150. For example, and without limitation, in some embodiments, additional septa 210 may be included in the manifold 150 to physically bolster the manifold 510 and/or narrow the channels to minimize crossmodes.

As specified in channel length/time delay constraints 555, each of the phasing plug rings 255 defines a different group—a set of the channels 310 having substantially the same channel length and, accordingly, sound waves that are optimally time aligned using substantially the same time delay. As part of the design of the manifold 150, for each of the groups, the channels 310 in the group are of substantially the same channel length and independently route sound waves from the drivers 160 (i.e., the inlets 165) in the group to the appropriate slots in the phasing plug ring 255 that defines the group.

In operation, for the group labelled "A," the loudspeaker processor 130 is configured to digitally delay the driver input signals 140 for drivers $\mathbf{160}_1$, $\mathbf{160}_3$, and $\mathbf{160}_5$ by the time delay $\text{time}_1$, and the delayed sound waves received at the inlets $\mathbf{165}_1$, $\mathbf{165}_3$, and $\mathbf{165}_5$ are routed via the channels $\mathbf{310}_1$, $\mathbf{310}_3$, and $\mathbf{310}_5$ through a distance of length, to the separate pairs of slots in the phasing plug ring $\mathbf{255}_1$. In a similar fashion, the group labelled "B" is associated with the time delay $\text{time}_2$, the inlets $\mathbf{165}_2$, $\mathbf{165}_4$, and $\mathbf{165}_6$, the channels $\mathbf{310}_2$, $\mathbf{310}_4$, and $\mathbf{310}_6$, the $\text{length}_2$, and the phasing plug ring $\mathbf{255}_2$. The group labelled "C" is associated with the time delay $\text{time}_3$, the inlets $\mathbf{165}_7$, $\mathbf{165}_9$, and $\mathbf{165}_{11}$, the channels $\mathbf{310}_7$, $\mathbf{310}_9$ and $\mathbf{310}_{11}$, the $\text{length}_3$, and the phasing plug ring $\mathbf{255}_3$. The final group, labelled "D," is associated with the time delay $\text{time}_4$, the inlets $\mathbf{165}_8$, $\mathbf{165}_{10}$, and $\mathbf{165}_{12}$, the channels $\mathbf{310}_8$, $\mathbf{310}_{10}$, and $\mathbf{310}_{12}$, the $\text{length}_4$, and the phasing plug ring $\mathbf{255}_4$.

The phasing plug rings 255 conform to various design criteria that ensure the integrity of the single point source of sound. For example, and without limitation, in some embodiments, the width of each of the phasing plug rings 255 is no greater than 0.25 inches. As persons skilled in the art will recognize, given the speed of sound, this constraint enables fine-tuning of the time delay with a time granularity of at least twenty microseconds. In other embodiments, without limitation, the phasing plug rings 255 are designed to maintain the width design constraints imposed on the channels 310. For example, and without limitation, in some embodiments, the channels 310 are constrained to a width no greater than half of the highest wavelength that is intended to be reproduced via the manifold 150. Correspondingly, in such embodiments, the radial distance between each of the phasing plug ring $\mathbf{255}i$ and the adjacent phasing plug ring $\mathbf{255}_{i+1}$ is no greater than half of this highest wavelength. In general, the phasing plug rings 255 may be designed in any technically feasible fashion based on any design criteria and/or constraint.

In alternate embodiments, any number and type of design criteria may be imposed on the phasing plug rings 255, the channels 310, the inlets 165, and the drivers 160. For example, and without limitation, some design criteria may represent constraints designed to optimize the fidelity of the sound emitted by the loudspeaker 110, such as limitations that minimize reflections and resonances within the manifold 150.

Configuring Loudspeakers

Figure 6:
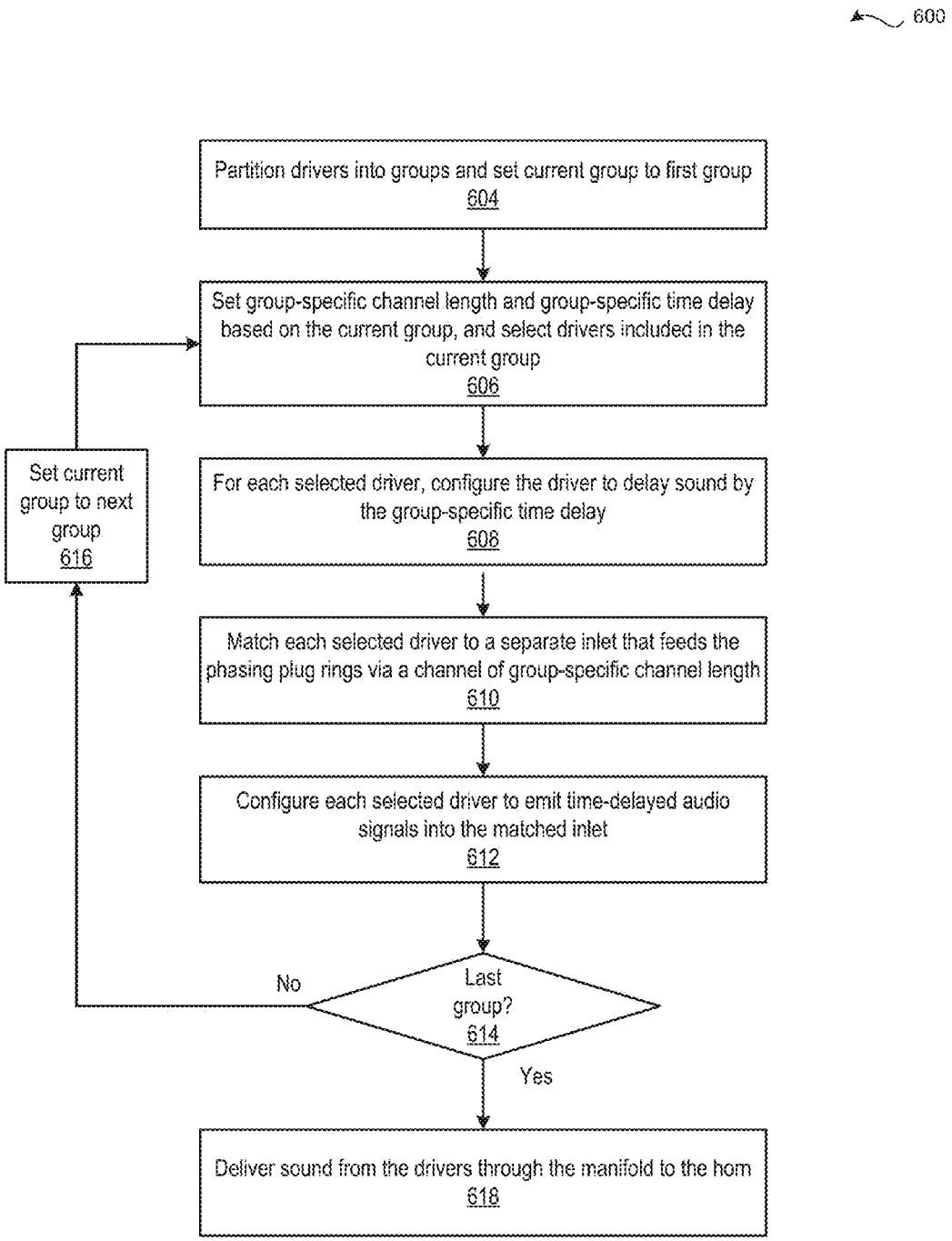
FIG. 6 is a flow diagram of method steps for configuring a loudspeaker for operation, according to various embodiments.

FIG. 6 is a flow diagram of method steps for configuring a loudspeaker for operation, according to various embodiments. Although the method steps are described in conjunction with the systems of FIGS. 1-5, persons skilled in the art will understand that any system configured to implement the method steps, in any order, falls within the scope of the present invention. The context of FIG. 6 is that the loudspeaker processor 130 configures the loudspeaker 110 to emit a single point source of sound based on the channel length/time delay constraints 555 that are associated with the manifold 150.

As shown, a method 600 begins at step 604, where the loudspeaker processor 130 partitions the drivers 160 into groups and sets a current group to the first of the groups. To optimize the operation of the manifold 150, the loudspeaker processor 130 assigns the drivers 160 to the groups based on the channel length/time delay constraints 555. In alternate embodiments, the loudspeaker processor 130 may partition the drivers 160 into groups in any technically feasible fashion that is consistent with the properties of the manifold 150, such as the number of unique values for the lengths of the channels 310. For example, and without limitation, in some embodiments, each of the channels 310 may have a different length and the loudspeaker processor 130 may assign the channels 310 to the groups in a one-to-one fashion.

At step 606, the loudspeaker processor 130 sets a group-specific channel length and a group-specific time delay based on the current group, and the select the drivers 160 that are included in the current group. More specifically, the loudspeaker processor 130 assigns the group-specific channel length and the group-specific time delay based on the channel length/time delay constraints 555 for the current group.

At step 608, the loudspeaker processor 130 matches each of the selected drivers 160 to a separate one of the inlets 165 that feeds the phasing plug rings 255 via one of the channels 310 that has the group-specific channel length. The loudspeaker processor 130 may perform the matching operations in any technically feasible fashion. For example, and without limitation, the loudspeaker processor 130 may assign the selected drivers 160 in a one-by-one fashion and in a clockwise and upward direction to the inlets 165 that feed the channels 310 having the group-specific channel length (per the channel length/time delay constraints 555).

At step 610, the loudspeaker processor 130 configures each of the selected drivers 160 to emit time-delayed sound waves into the matched inlet 165. In some embodiments, the loudspeaker processor 130 configures the driver input signals 140 that are associated with the selected drivers 160 to be delayed by the digital delays 135. In other embodiments, the loudspeaker processor 130 may perform any operations that inject delay into either the driver input signals 140 to the selected drivers 160, directly into the sound waves generated by the selected drivers 160, or any combination thereof. As part of step 610, the loudspeaker processor 130 also causes each of the selected drivers 160 to be coupled to the matched inlet 165. The loudspeaker processor 130 may precipitate this coupling in any technically feasible fashion. For example, and without limitation, in some embodiments the loudspeaker processor 130 may generate a digital image of the manifold 150 that is superimposed with the desired connections as assembly instructions.

At step 612, for each of the selected drivers 160, the loudspeaker processor 130 configures the driver 160 to delay sound by the group-specific time delay. The loudspeaker processor 130 may configure the driver 160 in any technically feasible fashion that is consistent with the manner in which the driver 160 is configured to emit time-delayed sound waves (step 610). For example, and without limitation, the loudspeaker processor 130 may set the value of the digital delay 135 that is associated with the selected driver 160 to the group-specific time delay.

At step 614, the loudspeaker processor 130 determines whether the current group is the last group that is implemented in the manifold 150. If, at step 614, the loudspeaker processor 130 determines that the current group is not the last group, then the method 600 returns to step 616. At step 616, the loudspeaker processor 130 sets the current group to the next group specified in the channel length/time delay constraints 555, and the method 600 returns to step 606 to process this group. The loudspeaker processor 130 continues to cycle through steps 606-614, configuring the drivers 160 for each of the groups until the loudspeaker processor 130 has processed all of the groups that are characteristic of the design of the manifold 150. In alternate embodiments, without limitation, any number and/or any types of processors may perform the functionality included in steps 606-614 in any combination. For example and without limitation, in some alternate embodiments, one processor may perform loudspeaker measurement and optimization operations and another processor may generate the appropriate time delays.

If, at step 616, the loudspeaker processor 130 determines that the current group is the last group, then the method 616 proceeds directly to step 618. At step 618, the loudspeaker processor 130 generates the driver input signals 160 thereby delivering sound waves from the drivers 160 through the manifold 150 to the acoustic horn 170. Notably, the loudspeaker processor 130 and the manifold 150 work together to ensure that the manifold 150 emits a single point source of sound into the throat of the acoustic horn 170. Advantageously, this highly coherent single point source of sound enables the acoustic horn to emit sound that is characterized by both high sound pressure levels and relatively high fidelity.

In sum, the disclosed techniques enable manifolds to effectively composite audio signals from multiple drivers into a single point source that is suitable for driving the throat of an acoustic horn. The manifold includes multiple inlets, where each inlet is designed to be coupled with a different driver and multiple, concentric phasing rings that combine to generate the single point source of sound. In operation, the sound waves that are received at each inlet are routed via an "isolation" channel to a different location in one of the concentric phasing rings. More specifically, the channels ensure that the sound waves received at each of the inlets do not interact with the sound waves received at the other inlets while travelling within the manifold-eliminating interference patterns between sound waves within the manifold. Further, to minimize reflections within the channels, each channel is relatively thin with respect the wavelengths that are intended to be reproduced by the loudspeaker.

To facilitate generation of the single point source of sound, each of the concentric phasing rings is fed by channels of approximately a ring-specific length and is associated with a time delay that corresponds to the ring-specific length. Accordingly, each of the drivers is configured with a digital delay that corresponds to one of the ring-specific time delays and is then coupled to an inlet that is routed to a concentric phasing ring that is associated with the ring-specific time delay. The tailored digital time delays compensate for delays incurred as the sound travels through the length of the channels, thereby time-aligning the sound waves at the exit of the manifold.

At least one advantage of the disclosed approaches is that they enable loudspeakers to generate coherent sounds with higher sound pressure levels than loudspeakers that are designed using conventional multi-driver techniques. Notably, by minimizing both comb filtering and acoustic interference patterns that can comprise the fidelity and intelligibility of the overall sound for the audience, the techniques described herein optimize the sound quality for audiences. Further, because the techniques outlined are applicable to any number of drivers arranged in any geometric fashion within the manifold, restrictions imposed on the design of the manifold are minimized. By contrast, multiple driver manifolds that employ conventional techniques are typically constrained to conform to relatively rigid design constraints, such as relative locations of the inlets.

The descriptions of the various embodiments have been presented for purposes of illustration, but are not intended to be exhaustive or limited to the embodiments disclosed. Many modifications and variations will be apparent to those of ordinary skill in the art without departing from the scope and spirit of the described embodiments.

Aspects of the present embodiments may be embodied as a system, method or computer program product. Accordingly, aspects of the present disclosure may take the form of an entirely hardware embodiment, an entirely software embodiment (including firmware, resident software, microcode, etc.) or an embodiment combining software and hardware aspects that may all generally be referred to herein as a "circuit," "module" or "system." Furthermore, aspects of the present disclosure may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

Aspects of the present disclosure are described above with reference to flowchart illustrations and/or block diagrams of methods, apparatus (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, enable the implementation of the functions/acts specified in the flowchart and/or block diagram block or blocks. Such processors may be, without limitation, general purpose processors, special-purpose processors, application-specific processors, or field-programmable The flowchart and block diagrams in the Figures illustrate the architecture, functionality, and operation of possible implementations of systems, methods and computer program products according to various embodiments of the present disclosure. In this regard, each block in the flowchart or block diagrams may represent a module, segment, or portion of code, which comprises one or more executable instructions for implementing the specified logical function (s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The invention has been described above with reference to specific embodiments. Persons of ordinary skill in the art, however, will understand that various modifications and changes may be made thereto without departing from the broader spirit and scope of the invention as set forth in the appended claims. For example, and without limitation, although many of the descriptions herein refer to specific types of audiovisual equipment and sensors, persons skilled in the art will appreciate that the systems and techniques described herein are applicable to other types of performance output devices (e.g., lasers, fog machines, etc.) and sensors. The foregoing description and drawings are, accordingly, to be regarded in an illustrative rather than a restrictive sense.

While the preceding is directed to embodiments of the present disclosure, other and further embodiments of the disclosure may be devised without departing from the basic scope thereof, and the scope thereof is determined by the claims that follow.

What is claimed is:

1. A manifold for a loudspeaker, comprising:

a plurality of inlets, wherein each inlet is designed to receive sound waves from a different compression driver;

an output section that includes a plurality of concentric rings and is designed to deliver a point source of sound to a throat section of an acoustic horn; and a first channel that is configured to guide sound waves received at a first inlet to a first location within a first concentric ring and to isolate the sound waves received at the first inlet from sound waves received at the other inlets included in the plurality of inlets.

2. The manifold of claim 1, wherein each of the concentric rings included in the plurality of concentric rings is associated with a different time delay.

3. The manifold of claim 2, wherein a first concentric ring is associated with a first time delay, and further comprising a second channel that is configured to guide sound waves received at a second inlet to a location in a second concentric ring that is associated with a second time delay.

4. The manifold of claim 3, wherein the first time delay is inversely correlated to the length of the first channel, and the second time delay is inversely correlated to the length of the second channel.

5. The manifold of claim 3, wherein the first time delay equals the second time delay, and the length of the first channel approximately equals the length of the second channel.

6. The manifold of claim 3, wherein the sound waves received at the first inlet are delayed by the first time delay, and the sound waves received at the second inlet are delayed by the second time delay.

7. The manifold of claim 6, wherein the first time delay is a digital delay.

8. The manifold of claim 1, wherein a width of the first concentric ring is no greater than 0.25 inches and the first concentric ring is configured to generate the point source of sound for the sound waves received at the first inlet with a time granularity of at least twenty microseconds.

9. The manifold of claim 1, wherein a radial distance between the first concentric ring and an adjacent concentric ring is no greater than half of a highest wavelength being reproduced via the manifold.

10. The manifold of claim 1, wherein the first channel is subdivided by at least one septum that extends from the first inlet to the first location in the first concentric ring.

11. The manifold of claim 10, wherein the at least one septum structurally reinforces the manifold.

12. A loudspeaker comprising:

an acoustic horn;

a plurality of compression drivers; and a manifold that is coupled to the acoustic horn and comprises:

a first inlet that receives sound waves from a first compression driver included in the plurality of compression drivers;

a second inlet that receives sound waves from a second compression driver included in the plurality of compression drivers;

an output section that includes a plurality of concentric rings, and is designed to deliver a point source of sound to a throat section of the acoustic horn;

a first channel that is configured to guide sound waves received at the first inlet to a first location within a first concentric ring and to isolate the sound waves received at the first inlet from sound waves received at the second inlet.

13. The loudspeaker of claim 12, wherein a radial distance between the first concentric ring and an adjacent concentric ring is no greater than half of a highest wavelength being reproduced via the manifold.

14. The loudspeaker of claim 12, wherein each of the concentric rings included in the plurality of concentric rings is associated with a different time delay.

15. The loudspeaker of claim 14, wherein the manifold further comprises a second channel that is configured to guide the sound waves received at the second inlet to a second location in the first concentric ring.

16. The loudspeaker of claim 14, wherein the first concentric ring is associated with a first time delay and a first compression driver is configured to deliver sound waves that are delayed by the first time delay to the first inlet.

17. A computer implemented method for configuring a loudspeaker for operation, wherein the loudspeaker includes a manifold that is designed to deliver a point source of sound to an acoustic horn, the method comprising:

partitioning a plurality of compression drivers into a plurality of groups, wherein each group is associated with a different channel length and a different time delay;

determining that a length of a first channel approximately equals a channel length that is associated with a first group, wherein the first channel guides sound waves received at a first inlet included in a plurality of inlets to a first location in an output section of the manifold and isolates the sound waves received at the first inlet from sound waves received at the other inlets included in the plurality of inlets; and configuring a compression driver included in the first group to deliver sound waves that are delayed by a time delay that is associated with the first group to the first inlet.

18. The method of claim 17, wherein the first location is within a first concentric ring included in a plurality of concentric rings.

19. The method of claim 18, wherein a radial distance between the first concentric ring and an adjacent concentric ring is no greater than half of a highest wavelength being reproduced via the loudspeaker.

20. The method of claim 17, further comprising:

determining that a length of a second channel approximately equals a channel length that is associated with a second group, wherein the second channel guides sound waves received at a second inlet included in the plurality of inlets to a second location in the output section of the manifold and isolates the sound waves received at the second inlet from sound waves received at the other inlets included in the plurality of inlets; and configuring a compression driver included in the second group to deliver sound waves that are delayed by a time delay that is associated with the second group to the second inlet.

* * * * *